United States Patent [19]

Murai et al.

[11] Patent Number: 4,804,035

[45] Date of Patent: Feb. 14, 1989

[54] METHOD OF GRAVITY CASTING

[75] Inventors: Takeshi Murai; Norifumi Sagawa, all of Hiroshima, Japan

[73] Assignees: Mazda Motor Corporation; Sinto Kogio, Ltd., both of Aki, Japan

[21] Appl. No.: 42,063

[22] Filed: Apr. 24, 1987

[30] Foreign Application Priority Data

Apr. 24, 1986 [JP] Japan ..... 61-95177

[51] Int. Cl.[4] ..... B22C 1/00; B22C 3/00

[52] U.S. Cl. ..... 164/125; 164/138

[58] Field of Search ..... 164/125, 122, 138, 72; 249/111, 114 R, 114 G; 427/133, 134, 135

[56] References Cited

U.S. PATENT DOCUMENTS 3,302,919 2/1967 Beetle et al. ..... 249/114 X 3,515,201 6/1970 Zimmerman ..... 164/72 X

FOREIGN PATENT DOCUMENTS 54-133426 10/1979 Japan ..... 164/138

59-169642 9/1984 Japan .

*Primary Examiner*—Nicholas P. Godici

*Assistant Examiner*—J. Reed Batten, Jr.

*Attorney, Agent, or Firm*—Gerald J. Ferguson, Jr.

[57] ABSTRACT

A method of carrying out gravity mold casting, i.e., pouring of molten metal into a mold cavity under the force of gravity. This particular method features the application of a heating insulating coating or an equivalent coating on the surfaces of an area the cross-sectional area of which is larger than that of other sections of the cavity and where the metal flowing speed is slower than in other areas of the mold. The coating is effected before pouring metal into the cavity.

12 Claims, 3 Drawing Sheets

METHOD OF GRAVITY CASTING

BACKGROUND OF THE INVENTION

1. Field of the Invention

This invention relates to a method of gravity casting in which molten metal is poured into a cavity of a mold under the force of gravity.

2. Description of the Prior Art

For example, when manufacturing a crankshaft 10 as shown in FIG. 3 by casting of ductile iron (spheroidal graphite cast iron), a gravity casting mold 1 as shown in FIG. 1 is generally used. The mold 1 is of a type to be opened and closed (the parting face is indicated at 1*a* in FIG. 1) and has a cavity 2 conforming to the crankshaft 10 in shape and extending in the vertical direction. A molten metal passage 3 is formed to be communicated with a lower end portion of the cavity 2 and to open upward at a pouring gate 4. Molten metal is poured into the molten metal passage through the pouring gate to fill the cavity 2 under the force of gravity.

The crankshaft 10 comprises a shaft portion 11, a pin portion 12 and a counterweight portion 13, and at the counterweight portion 13, the cross-sectional area of the molten metal path as measured in the direction perpendicular to the direction of molten metal flow increases abruptly as compared with the cross-sectional areas of the shaft portion 11 and the pin portion 12.

A large change in the cross-sectional area can generate surface defects in the cast products (crankshaft 10) due to difference in the rate of the molten metal cooling through contact with the mold 1 caused by change in the rising rate of the molten metal level in response to change of the cross-sectional area.

In order to prevent wear of the mold 1, a coating is applied to the mold surface. In the case of casting of ductile iron, wrinkle-like surface defects (indicated at A in FIG. 3) extending in the axial direction of the product are produced at portions having a relatively small cross-sectional area, e.g., the shaft portion 11 and the pin portion 12, due to the heat insulating effect of the coating. Further, similar wrinkle-like surface defects (not shown) may be generated on upper and lower flat surfaces 13*a* of the counterweight portions 13. Due to the heat insulating coating, the cooling rate of the molten metal is decreased to form a thin solidified layer, and the thin solidified layer is twisted by fluidized portion of the molten metal flowing at a relatively high speed, thereby generating the wrinkle-like surface defects. This phenomenon is particularly significant in casting of ductile iron, whose rate of solidification is generally low.

On the other hand, when the coating is not applied, the cooling rate of the molten metal is increased and the solidification mode of the molten metal is changed to "skin-formation type", and accordingly, though the surface defects A on the relatively small cross section portions such as the shaft portion 11 and the pin portion 12 can be reduced, wrinkle-like surface defects (indicated at B) extending in the transverse direction of the product are generated on the outer peripheral portion 13*b* of the counterweight portions 13 having a large cross-sectional area. Molten ductile iron has a large surface tension, and the corner between a free surface of the molten ductile iron and the mold surface has a large radius of curvature. At the outer peripheral portion 13*b* of the counterweight portion 13 at which the cross-sectional area corresponding to the direction of rise of the molten metal level is abruptly enlarged, the part of the molten metal in contact with the mold surface is partly solidified as it has a large radius of curvature due to lowered rising rate of the molten metal level, whereby weldline-like surface defects are generated when the molten metal level subsequently rises.

SUMMARY OF THE INVENTION

In view of the foregoing observations and description, the primary object of the present invention is to provide a method of gravity casting in which generation of wrinkle-like surface defects is prevented.

In accordance with the method of the present invention, a heat insulating layer is first formed solely on the side surface portions of an increased cross section portion in the cavity of the mold at which the cross-sectional area is relatively large so that flow speed of the molten metal is lowered, and then the molten metal is poured into the cavity.

That is, in the case of the mold shown in FIGS. 1 and 2, a heat insulating layer 6 is formed solely on the side surface portion 5*a* of the increased cross section portion 5 for casting the counterweight portion, and no heat insulating layer is formed on small diameter portions 7.

The heat insulating layer 6 may be formed by brushing, spraying or embedding of a heat insulating material such as alumina type basic coatings, alumina type basic coatings with acetylene black, graphite and ceramics. When the heat insulating layer is formed by applying a coating material, the thickness of the layer is preferably 30 to 300$\mu$ though depending on the kind of the coating material. More specifically, if the thickness of the heat insulating layer is smaller than 30$\mu$, a sufficient heat insulating effect cannot be obtained, while a thickness of larger than 300$\mu$ is not necessary.

Normal ductile iron can be suitably used as the casting material though it is preferred that the carbon component be reduced up to 3.4%, for instance, and the silicon component be reduced to 2.2%, for instance. Further, generation of the wrinkle-like surface defects can be reduced by lowering the initial temperature of the mold to 80° C., for instance, and by effecting casting at a relatively low temperature, e.g., 1310° C.

In the method of the present invention, by forming a heat insulating layer on the portion at which the cross-sectional area of the cavity is relatively large and the rising rate of the molten metal level is slow, the skin portion of the molten metal is prevented from being partly solidified by the heat insulating effect of the layer, whereby generation of the surface defects like transverse wrinkles is prevented.

On the other hand, since the portion of the cavity having a relatively small cross-sectional area is free from a heat insulating layer, the molten metal is abruptly cooled at the portion to obtain skin-formation type solidification mode, whereby generation of wrinkle-like surface defects at the portion can be prevented.

By thus controlling the cooling characteristics according to the cross-sectional area, casting products free from surface defects can be obtained.

DESCRIPTION OF THE PREFERRED EMBODIMENT

Figure 1:
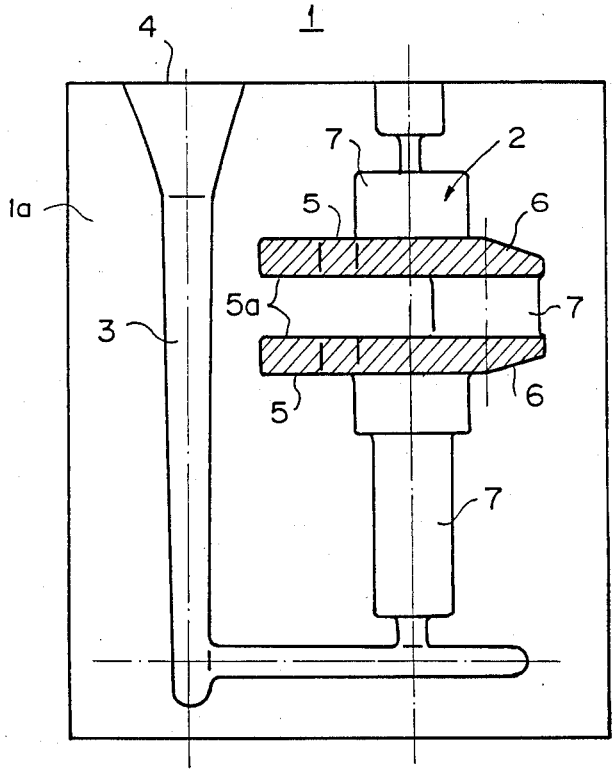
FIG. 1 is a front view showing an example of a mold which is used for carrying out the method of the present invention.
Figure 2:
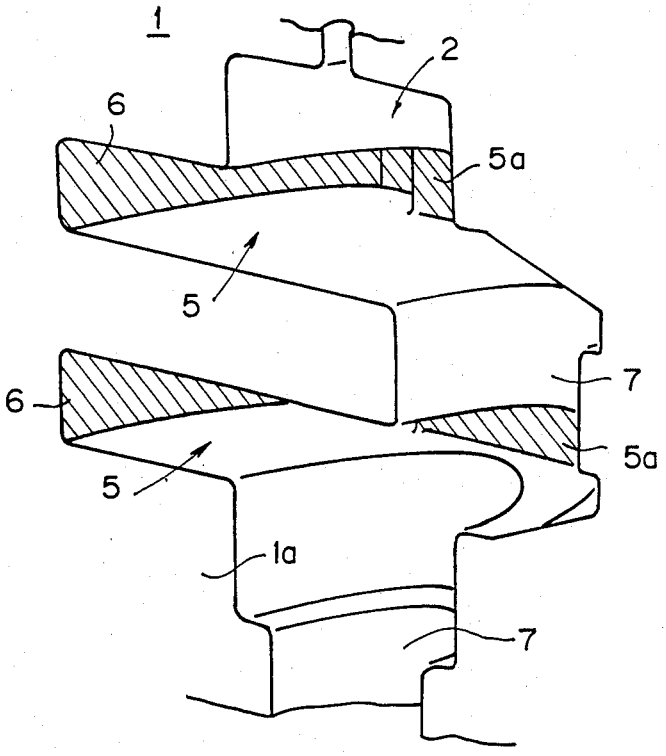
FIG. 2 is an enlarged fragmentary perspective view showing a part of the mold shown in FIG. 1.
Figure 3:
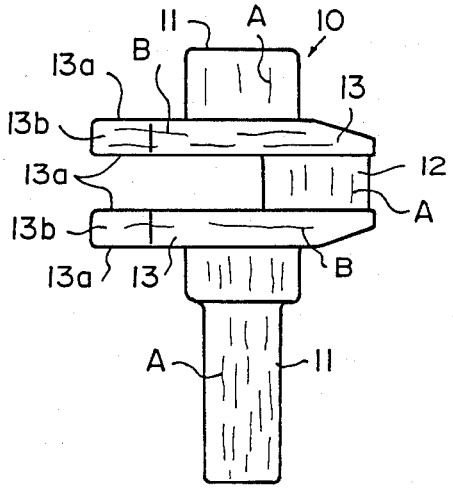
FIG. 3 PRIOR ART
FIG. 3 is a front view showing a crankshaft cast by the mold.

Using casting molds as shown in FIGS. 1 and 2, crankshafts were cast by casting of ductile iron in accordance with the method of the present invention and in accordance with methods other than the present invention (as controls), and the surface defects generated on the small cross-sectional portions (the shaft portion 11 and the pin portion 12), the flat portions 13*a* of the counterweight portion 13 and the outer peripheral portions 13*b* of the counterweight portion 13 were measured. The results obtained are shown in FIG. 4.

Figure 4:
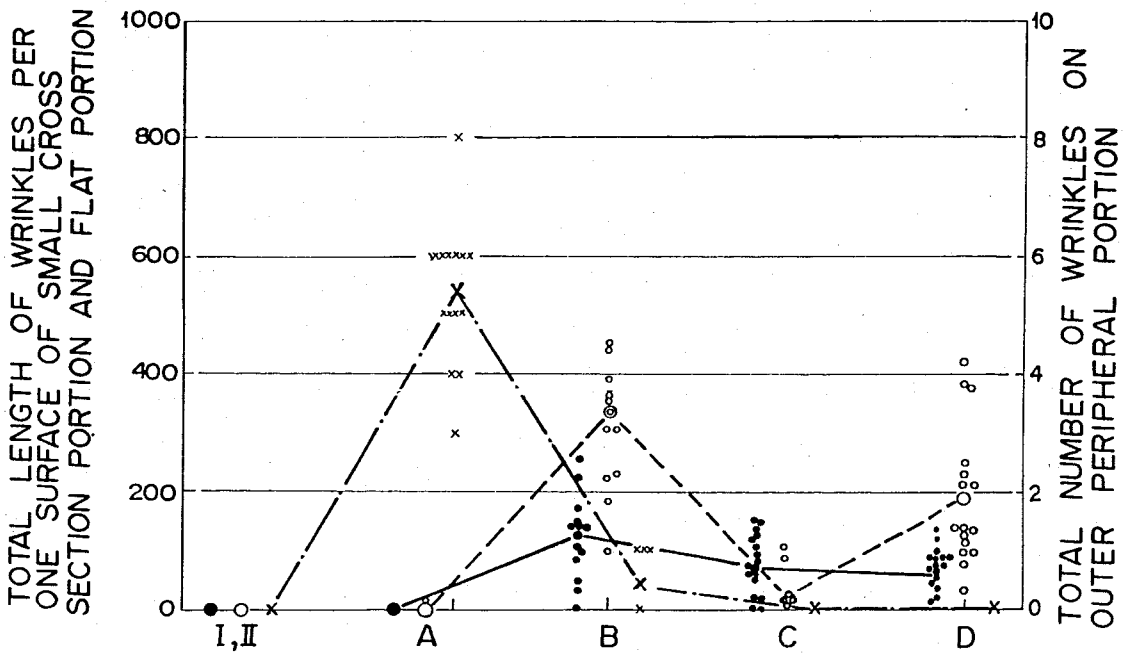
FIG. 4 is a graph showing the result of the invention in comparison with controls.

As for the surface defects on the small cross-section portion, the lengths of vertical wrinkles were summed up and represented by in FIG. 4. As for the surface defects on the flat portions 13*a*, the lengths of wrinkles were summed up and represented by in FIG. 4. As for the surface defects on the outer peripheral portions 13*b*, the number of transverse wrinkles was counted and represented by x in FIG. 4.

In the casting in accordance with the first embodiment of the present invention, the conditions were as follows.

I. Alumina type basic coating was applied to the side surface portions 5*a* of the increased cross section portion 5 of the mold cavity. The composition of the ductile iron was as follows and the molten ductile iron was spherodized by adding 1% of spherodizer (JMM-M5) by sandwiching method and at the same time inoculated with 0.4% of inoculum (stream MSP).

Composition of the ductile iron (%) . . . C 3.39 to 3.57, Si 2.13 to 2.32, Mn 0.46 to 0.47, S 0.008 to 0.009, Mg 0.022 to 0.027, Cu 0.75 to 0.79. The molten metal processed as described above was poured into the mold at 1310° C. The initial mold temperature was about 80° C.

In the casting in accordance with the second embodiment of the present invention, the conditions were as follows.

II. Alumina type basic coating mixed with acetylene black was applied to the side surface portions 5*a* of the increased cross section portion 5 of the mold cavity by spraying using a masking plate. The composition of the ductile iron was as follows and the molten ductile iron was processed in the same manner as the first embodiment.

Composition of the ductile iron (%) . . . C 3.25 to 3.45, Si 2.16 to 2.20, Mn 0.29, S 0.018 to 0.021, Mg 0.023 to 0.031, Cu 0.76 to 0.88.

The molten metal was poured into the mold under the same condition as in the first embodiment.

First to fourth control castings (A to D) were carried out under the following conditions.

A. Coating was not applied.

B. Acetylene black was applied over the entire surface of the cavity.

C. Basic coating SD100 was applied over the entire surface of the cavity.

D. Basic coating SD100 mixed with acetylene black was applied over the entire surface of the cavity.

In all control castings, the composition of the ductile iron was as follows and the molten ductile iron was processed in the same manner as the first embodiment.

Composition of the ductile iron (%) . . . C 3.4 to 3.9, Si 2.2 to 2.8, Mn 0.3, P less than 0.04, S less than 0.015, Mg 0.022, Cu 0.8.

The molten metal was poured into the mold at 1310° C. or 1380° C. The initial mold temperature was 80° C. or 150° C.

As can be understood from FIG. 4, in accordance with the first and second embodiments of the present invention, no wrinkles were produced at any portion.

On the other hand, in the case of the control castings B, C and D in which coatings were applied over the entire area of the cavity surface, wrinkles at the small cross-section portion were produced to substantially the same extent, while no wrinkles were produced at the small cross-section portion in the case of the control casting A in which no coating is applied to the cavity surface. In the case of the control casting B in which acetylene black was coated over the entire area of the cavity surface, wrinkles were produced on the flat portions of the counterweight portion to a remarkable extent, while in the case of the control casting A and C, wrinkles on the flat portions were not so pronounced. Wrinkles on the outer peripheral portions of the counterweight portion were pronounced in the case of the control casting A in which no coating was applied to the cavity surface, and were not found in the case of the control casting C and D in which basic coating was applied over the entire cavity surface. That is, in the case of the control casting A in which no coating was applied to the cavity surface, wrinkles were found on neither the small cross section portion nor the flat portions of the counterweight portion, irrespective of other conditions.

It is presumed that this is because solidification is quickly promoted at the surface portion of the product and the metal in the surface portion changes to white pig iron to form a strong skin layer due to lack of heat insulating effect. Further it was found that wrinkles on the small cross section portion and the flat portions were more pronounced in the lower portion of the product than in the upper portion of the same. On the other hand, wrinkles on the outer peripheral portion were more pronounced in the upper portion of the product. It is presumed that this is because the area of the molten metal surface is substantially larger at the counterweight portion than at the shaft portion or the pin portion and accordingly the rising rate of the molten metal level is decreased to a large extent, whereby part of molten metal surface in contact with the cavity surface is solidified.

Further it was found that as the carbon and silicon contents are reduced, generation of wrinkles is reduced. Probably this is because change of ductile iron to white pig iron is promoted by reduction of the carbon and silicon contents, which promote change of ductile iron to graphite, and a strong skin layer is formed at the interface between the molten metal and the cavity surface. No sink marks were found even though the contents of carbon (3.4%) and silicon (2.2%) were small.

Almost no effect of the initial mold temperature on generation of wrinkles was found. However, in the case that the casting temperature was high, generation of wrinkles at the small cross section portion and the flat portions was reduced as the initial mold temperature was lowered. It is presumed that this is because as the initial mold temperature is lowered, the temperature difference between the molten metal and the cavity surface is enlarged to increase the quantity of heat transferred to the mold from the molten ductile iron, and change of the ductile iron to white pig iron is promoted.

Further it was found that as the casting temperature was lowered, generation of wrinkles on the small cross section portion and outer peripheral portion was reduced.

We claim:

1. A method of casting a product by pouring molten ductile iron into a cavity of a mold under the force of gravity, said cavity having a longitudinal axis, characterized by the steps of forming a heat insulating coating material solely on the side surface portions of an increased cross section portion in the cavity of the mold at which the cross sectional area is relatively large and at which flow speed of the molten ductile iron is lowered, and subsequently pouring the molten ductile iron into the cavity, said molten ductile iron entering at the bottom end of said cavity by being forced through a pouring gate and then a passage to said cavity under the force of gravity.

2. A method as defined in claim 1 in which said heat insulating coating mateerial is formed by applying coating material on the cavity surface in a thickness of 30 to 300$\mu$.

3. A method as defined in claim 1 in which said heat insulating coating material is formed of alumina type basic coating.

4. A method as defined in claim 1 in which said heat insulating coating material is formed of alumina type basic coating mixed with acetylene black.

5. A method as defined in claim 1 in which said heat insulating coating material is formed of graphite coating.

6. A method as defined in claim 1 in which said heat insulating coating material is formed of ceramic coating.

7. A method as defined in claim 1 in which the composition of said molten ductile iron is such as to produce cast iron containing 3.4 to 3.9% of carbon and 2.2 to 2.8% of silicon.

8. A method as defined in claim 7 in which the mold is initially maintained at a temperature of 80° C. to 150° C.

9. A method as defined in claim 8 in which the molten ductile iron is poured into the cavity at a temperature of 1310° C. to 1380° C.

10. A method as in claim 1 where said pouring gate and said passage have a substantially common axis and where the latter axis is substantially parallel to the longitudinal axis of the cavity.

11. A method as defined in claim 10 where all of said axes are substantially vertically oriented.

12. A method as in claim 10 where said increased cross-section portion is substantially perpendicular with respect to said longitudinal axis of the cavity.

* * * * *